US010792580B2

(12) United States Patent
Miller

(10) Patent No.: US 10,792,580 B2
(45) Date of Patent: Oct. 6, 2020

(54) MULTI-FUNCTION MODULAR ROBOT APPARATUS WITH STACKABLE, INTERCHANGEABLE AND INTERLOCKING MODULES

(71) Applicant: Kenneth C. Miller, Aptos, CA (US)

(72) Inventor: Kenneth C. Miller, Aptos, CA (US)

( * ) Notice: Subject to any disclaimer, the term of this patent is extended or adjusted under 35 U.S.C. 154(b) by 0 days.

(21) Appl. No.: 15/566,891

(22) PCT Filed: Dec. 24, 2015

(86) PCT No.: PCT/IB2015/002418

§ 371 (c)(1),
(2) Date: Oct. 16, 2017

(87) PCT Pub. No.: WO2016/174494

PCT Pub. Date: Nov. 3, 2016

(65) Prior Publication Data

US 2018/0290067 A1 Oct. 11, 2018

Related U.S. Application Data

(60) Provisional application No. 62/153,521, filed on Apr. 28, 2015.

(51) Int. Cl.

| | |
|---|---|
| ***A63H 33/00*** | (2006.01) |
| ***A63H 17/00*** | (2006.01) |
| ***A63H 17/36*** | (2006.01) |
| ***A63H 11/00*** | (2006.01) |
| ***A63H 33/06*** | (2006.01) |

(52) U.S. Cl.

CPC ..... *A63H 17/36* (2013.01); *A63H 11/00* (2013.01); *A63H 17/002* (2013.01); *A63H 33/005* (2013.01); *A63H 33/06* (2013.01); *A63H 2200/00* (2013.01)

(58) Field of Classification Search

CPC .... A63H 17/002; A63H 11/00; A63H 33/005; A63H 33/042; A63H 2200/00

See application file for complete search history.

(56) References Cited

U.S. PATENT DOCUMENTS 2,725,234 A * 11/1955 Coble ..... A63F 9/12 273/157 R
4,717,364 A * 1/1988 Furukawa ..... A63H 11/00 367/198

(Continued)

OTHER PUBLICATIONS

International Search Report dated Apr. 7, 2016 for International Application No. PCT/IB2015/002418 filed Dec. 24, 2015.

*Primary Examiner* — Eugene L Kim
*Assistant Examiner* — Alyssa M Hylinski
(74) *Attorney, Agent, or Firm* — Blue Filament Law PLLC

(57) ABSTRACT

A multi-function modular robot apparatus provides a wide range of entertainment and functional use options that may be tailored by a user to the specific entertainment and functional purposes so desired. The specific entertainment and functional purposes of the multi-function modular robot apparatus are obtained through inclusion of multiple stackable modules. The interlocking mechanical and electric communications connections for each stackable module act as a power and electronic communication pass through to allow for each module to be arranged in any order and in any combination while still maintaining power and function.

17 Claims, 8 Drawing Sheets

(56) References Cited

U.S. PATENT DOCUMENTS

| | | | | |
|---|---|---|---|---|
| 5,685,383 | A | 11/1997 | Ferrante | |
| 5,700,177 | A * | 12/1997 | Lemelson | A63F 9/12 273/156 |
| 6,739,567 | B1 | 5/2004 | Curtis | |
| 6,764,373 | B1 | 7/2004 | Osawa et al. | |
| 6,877,096 | B1 * | 4/2005 | Chung | A63F 13/02 713/185 |
| 2003/0007321 | A1 * | 1/2003 | Dayley | H05K 5/0021 361/679.6 |
| 2006/0293110 | A1 * | 12/2006 | Mendelsohn | A63G 1/00 472/137 |
| 2008/0278314 | A1 | 11/2008 | Miller et al. | |
| 2013/0115848 | A1 * | 5/2013 | Silverglate | A63H 33/006 446/124 |
| 2014/0009561 | A1 * | 1/2014 | Sutherland | F16M 11/42 348/14.05 |
| 2014/0100012 | A1 | 4/2014 | Miller | |
| 2015/0234398 | A1 * | 8/2015 | Harris | B25J 9/0003 700/250 |
| 2016/0101370 | A1 * | 4/2016 | Madsen | H04W 4/026 446/91 |
| 2016/0184725 | A1 * | 6/2016 | Wong | A63H 30/04 446/268 |
| 2016/0242232 | A1 * | 8/2016 | Deros | F21V 33/0048 |

* cited by examiner

MULTI-FUNCTION MODULAR ROBOT APPARATUS WITH STACKABLE, INTERCHANGEABLE AND INTERLOCKING MODULES

CROSS REFERENCE TO RELATED APPLICATIONS

This application claims priority benefit of U.S. Provisional Application Ser. No. 62/153,521 filed 28 Apr. 2015; the contents of which are hereby incorporated by reference.

FIELD OF THE INVENTION

The present invention relates to robotics and more particularly relates to a multi-function modular robot apparatus having stackable, interchangeable, and interlocking modular components, each with a different capability and function, which are arrangeable in a variety of permutations, thereby allowing for user-tailored functionality thus providing a flexible and optimized user-based entertainment or functional experience.

BACKGROUND OF THE INVENTION

Most electronic devices are narrowly tailored to provide a static form of entertainment or functionality (e.g., camera for taking photos, speakers for playing music, console for playing video games, faux-gun for shooting foam projectiles or water, smoke and carbon monoxide detectors for safety). The entertainment or functional value of such devices is limited. As a result, the consumer must purchase separate devices for every form of entertainment and functionality so desired. As a natural consequence, the consumer amasses a collection of single-purpose electronic devices and must switch between use of any given device depending on the type of entertainment or functionality so desired.

Additionally, most entertainment-themed robots are intended for use in single-purpose games where the robots may push each other around (sumo), destroy each other (e.g., BattleBots, RobotWars, etc.), or play some form of soccer (push/roll/kick a ball into a goal). Some entertainment-themed robots have incorporated additional entertainment features (e.g., ability to play music or record video). However, there are currently no entertainment-themed robots that provide for multiple and interchangeable forms of entertainment and functionality.

Toys-to-life is a genre of video game using physical figurines or action figures to interact within the game. Toys-to-life use a near field communication (NFC), radio frequency identification (RFID), or image recognition data protocol to determine the individual figurine's proximity, and save a player's progress data to a storage medium located within that piece. The use of near field communication (NFC) allow the figurines to interact with supported video game software, potentially allowing data to be transferred in and out of games and across multiple computer and gaming platforms. The figurines may be based on famous individuals, of fictional characters from television, cartoons, animated features, and movies. The figurines may be pre-assembled, or may be assembled as part of the game by unlocking the levels in-game, which shows the player the building instructions.

Thus, there exists a need for a multi-function modular robot apparatus that unifies a variety of entertainment and functionality options through resort to stackable, interchangeable and interlocking modular components, each with a different capability and function, that are arrangeable in a variety of permutations, thereby allowing for user-tailored functionality thus providing a flexible and optimized user-based entertainment or functional experience, while also providing a degree of durability during rough usage.

SUMMARY OF THE INVENTION

A multi-function modular robot apparatus includes: a first plurality of stackable modules, each of the first plurality of stackable modules includes: a module housing having a top face, a bottom face, the top face adapted to receive an interlocking mechanical and electrical communications component integral with the bottom face of another of the first plurality of stackable modules; and a robotic platform including: a module interface cutout adapted to receive the bottom face of one of the first plurality of stackable modules.

A method of playing a target-and-shoot game includes: securing a multi-function robot apparatus on the roof of an automobile; driving the automobile along a route; finding and imaging quick response (QR) code targets or laser tag targets posted along the route using a separate user operable remote control component.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

Figure 1:
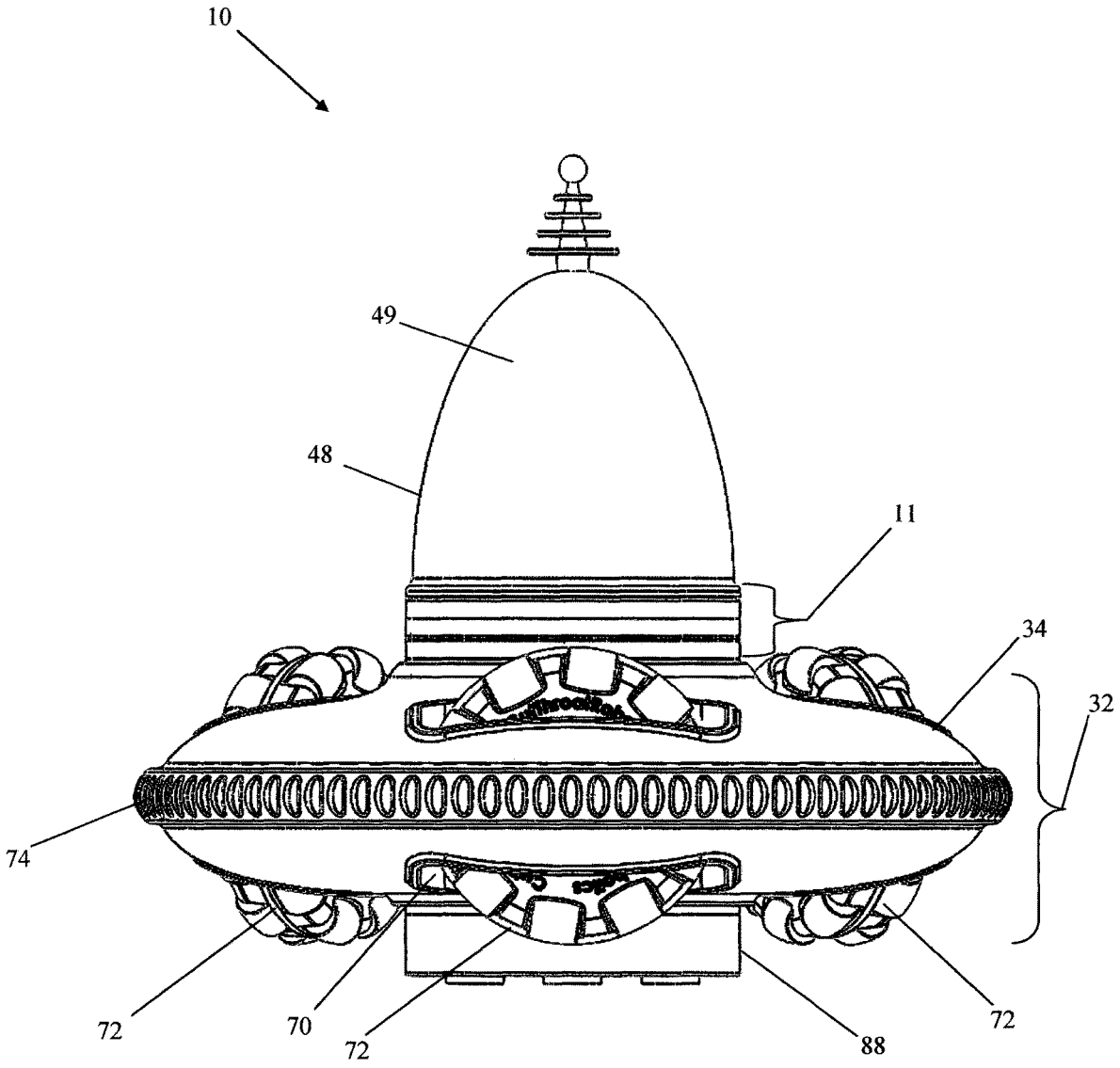
FIG. 1 is a side view of the multi-function modular robot apparatus according to one embodiment of the invention

The present invention has utility as a multi-function modular robot apparatus. Representative benefits of the present invention include providing a wide range of entertainment and functional use options that can be tailored by a user to the specific entertainment and functional purposes so desired.

In view of the foregoing disadvantages inherent in known types of robots with limited entertainment or functional abilities, this invention provides a multi-function modular robot apparatus having multiple stackable modules.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

With reference now to the drawings, the preferred embodiment of the multi-function robot apparatus is herein described. It should be noted that the articles "a", "an", and "the", as used in this specification, include plural referents unless the content clearly dictates otherwise.

The present invention represents a departure from the prior art in providing a dynamic robot platform to perform a variety of functions through inclusion of one or more stackable modules. It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Figure 2:
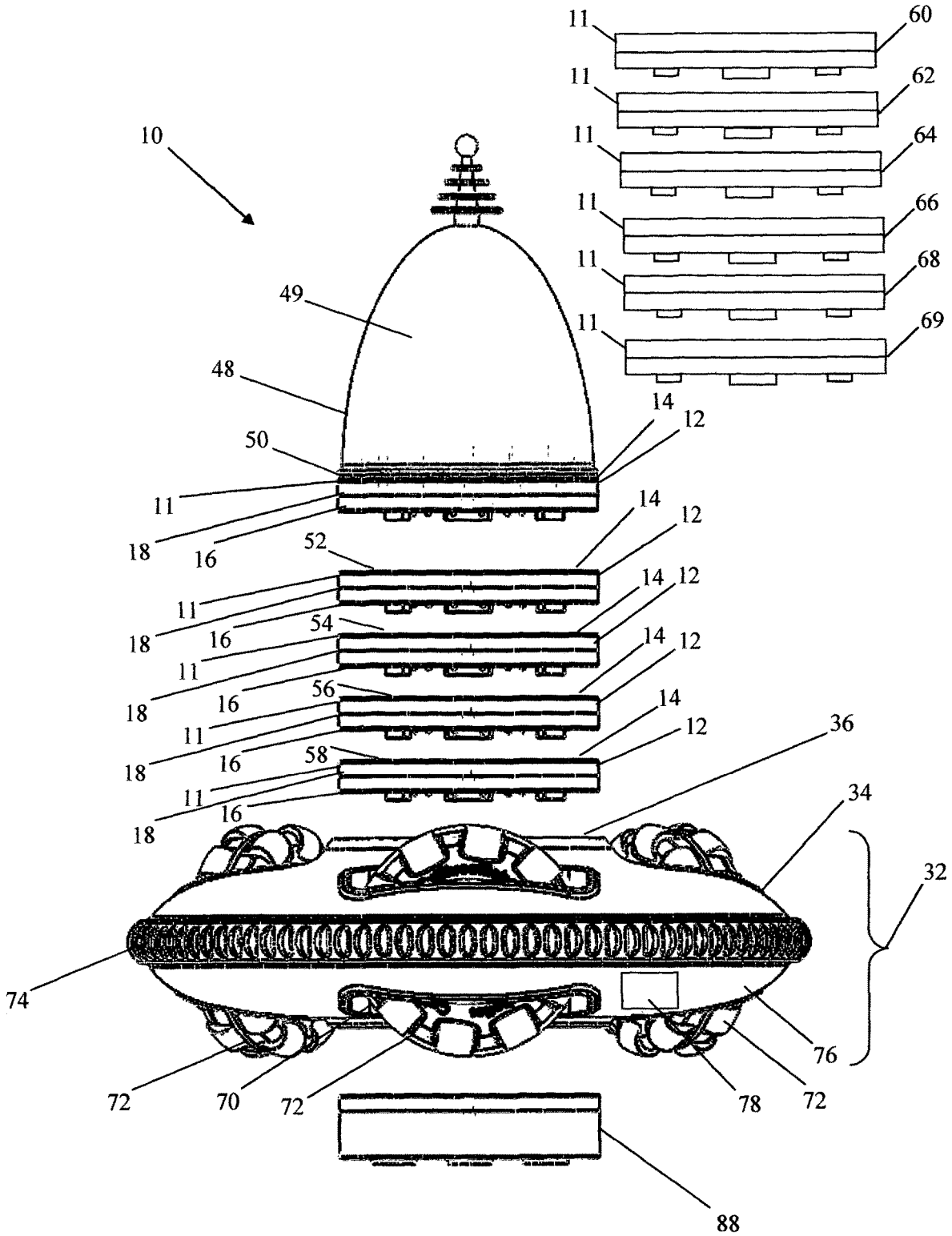
FIG. 2 is an exploded view of the multi-function modular robot apparatus according to one embodiment of the invention.
Figure 3A:
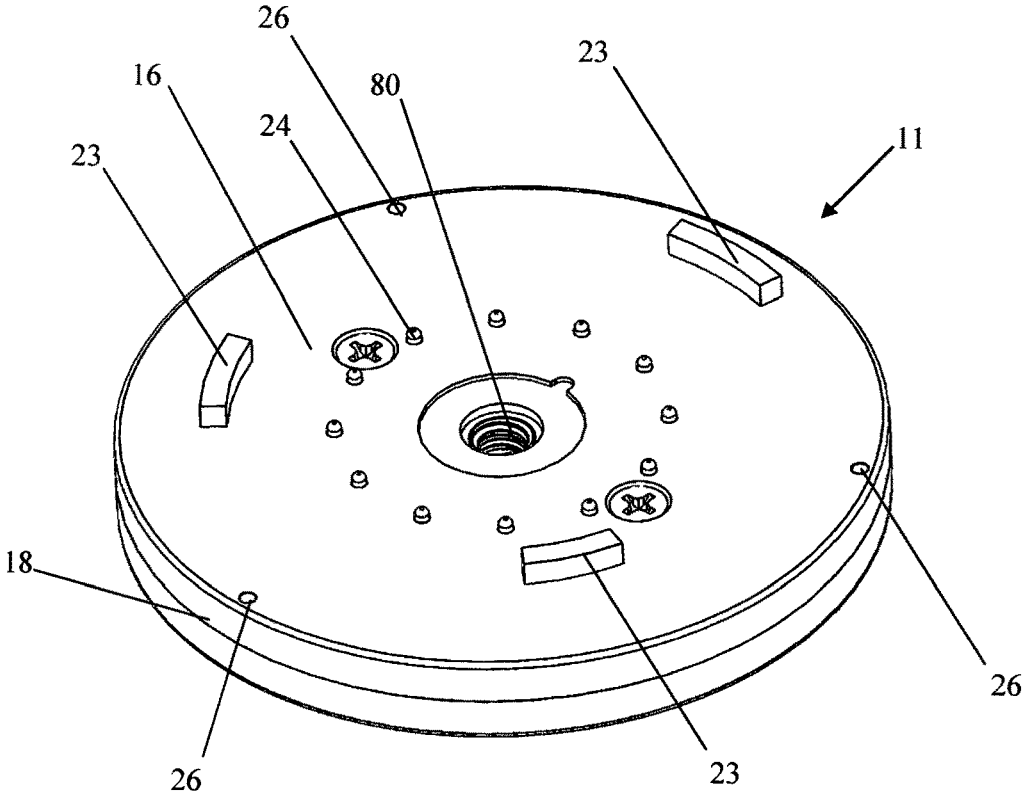
FIGS. 3A-3E are a series of views of a stackable module according to one embodiment of the invention.
Figure 3B:
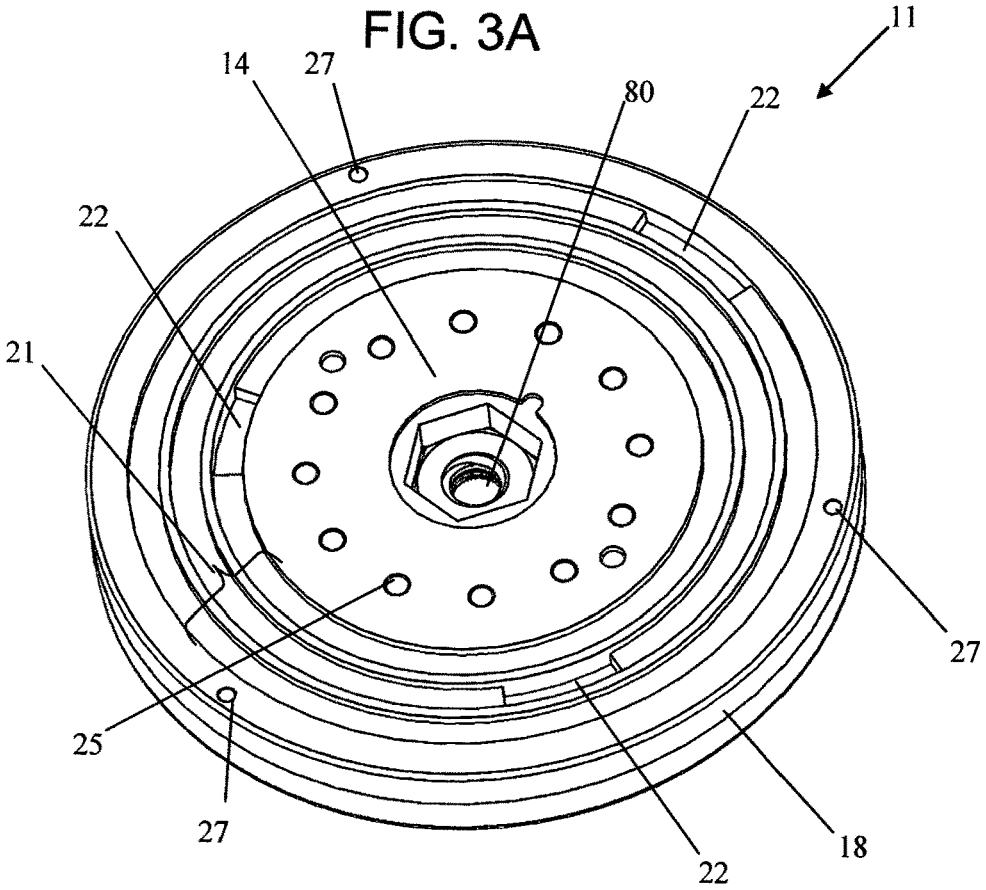
Figure 3C:
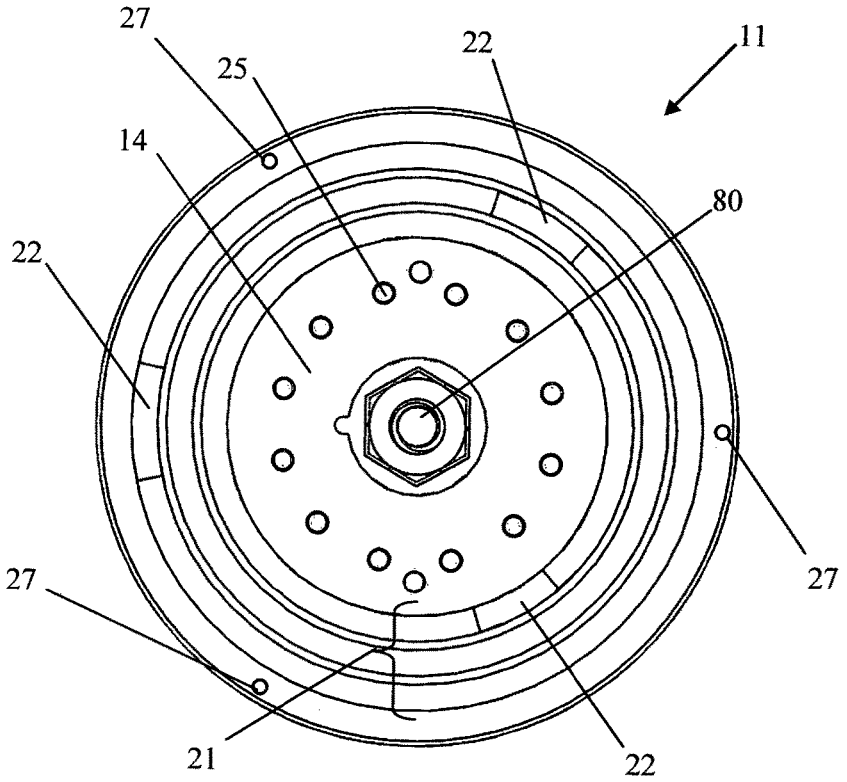
Figure 3D:
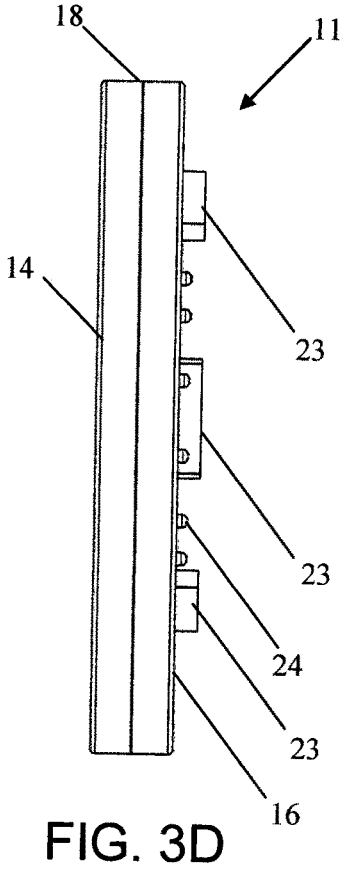
Figure 3E:
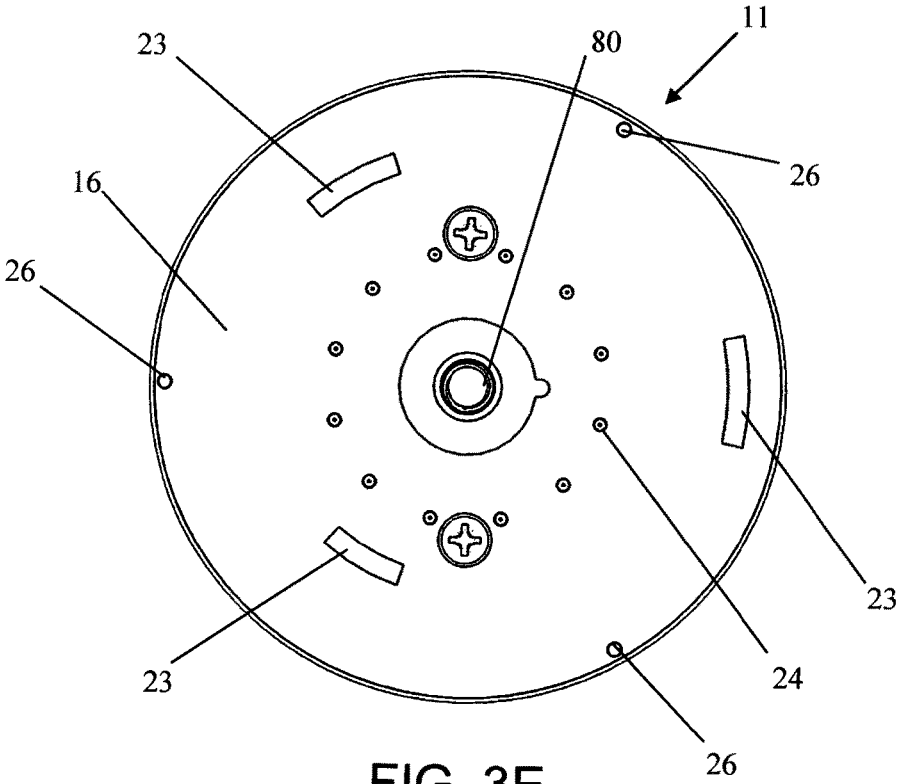

Referring now to the figures, an embodiment of the inventive multi-function modular robot apparatus 10 is shown in FIG. 1 and as an exploded view in FIG. 2. The multi-function modular robot apparatus 10 has a first plurality of stackable modules 11, each module of the first plurality of stackable modules 11 has a module case housing 12 having a top face 14, a bottom face 16, a side face 18. As best shown in FIGS. 3A-3E the top face 14 has a series of locating depressions 22 that provide a complementary fit to the protruding locating features 23 of bottom face 16. A series of protruding electrical/communications male contacts 24 are integral with the bottom face 16 and oriented parallel thereto that align with a series of female electrical/communications contacts/pads 25 in the top face 14. Electrical connections include power, control signal components, and sensor feedback from sensors that may be part of a module. Communications includes software commands. In a specific embodiment the male contacts 24 are pogo pins that line up with the contact pads 25 on the module face 14 below. Pogo Pins 24 stick out 1 mm from surface—compress 1 mm to flush when engaged with module below. The pins 24 are protected by the three tabs 23 which protrude below the surface 2 mm. The pogo pins 24 clear the corresponding contact pads 25 on the module below during an engagement/rotation process (describe further below)—pins 24 only make contact and compress when the tabs 23 drop into the pockets 22. The pogo pins 24 are configured to carry power, ground, and signals.

In a specific embodiment a set of magnet pairs 26/27 provide a mutual attraction to hold the stackable modules 11 together. In the embodiment shown in FIGS. 3A-3E top magnets 27 are positioned in the top face 14 of the stackable modules 11, while bottom magnets 26 are positioned in the bottom face 16. It is appreciated that an attraction magnet may be long enough to extend the entire depth of the module from the top face 14 to the bottom face 16 and be oriented so that all N poles are facing up (i.e., at point 27) and the S poles facing down (i.e., at point 26).

In a specific embodiment of a coupling mechanism formed with locating depressions 22 and locating features 23, the complementary features may be configured as a first set of magnets that comprise the protruding locating features 23, and a second set of magnets or metal plates are disposed within the locating depressions 22 to form an attraction or attachment force. It is appreciated that the locating depressions 22 are adapted to receive and may interlock with the protruding locating features 23 and provide for the correct orientation and placement of the electrical and communications connections 24/25 between the stackable modules 11. The mechanical locating features 23/24 orient the electrical and communications connections 24/25 for each module of the first plurality of modules 11 to also act as a power and electronic communication pass through 24/25 to allow for each module of the first plurality of modules 11 to be arranged in any order and in any combination while still maintaining power and function. It is appreciated that in specific embodiments the magnet pairs 26/27 and/or the mechanical coupling 22/23, and the electrical and communications component 24/25 simultaneously provide a breakaway function to guard against damage to each module of the first plurality of modules 11 during rough usage of the multi-function modular robot apparatus 10. In a specific embodiment as shown in FIGS. 3A-3E the top interface 14 has three concentric rings (female), and three pockets at the bottom of the rings (Female) that joins with the bottom interface 16 of a separate module, where the bottom interface 16 has three tabs (male) 23 that first engage in the three concentric rings 21 in the module below to hold the modules concentric, and then a user rotates the joining module until the tabs drop into the pockets 22 to orient and align the modules to each other (only one way the modules line up—keyed). It is appreciated that alternative coupling mechanism are known to the art beyond the exemplary version depicted in the figures, these illustratively include complementary threads, bayonet-type fittings, male-female fittings, and prong fittings.

A robotic platform 32 has a robotic platform case housing 34 and a module interface cutout 36 adapted to receive the bottom face 16 of one of the first plurality of modules 11. The robotic platform casing housing 34 has a series of locating depressions 22 (not visible) that provide a complementary fit to the protruding locating features 23 from the bottom face 16 of one of the first plurality of modules 11 that is at the bottom of a stack. As noted above a set of magnets may be located directly beneath the locating depressions 22 in the module interface cutout 36 that are oriented in positions corresponding to the positions of the set of first magnets disposed within each of the protruding locating features 23 of the first plurality of modules 11.

It is appreciated that each of the first plurality of modules 11 has a distinct function including a computer driver module, a motor driver module, a display module 48, a lights module 50, a camera module 52, a sound module 54, a turret module 56, and a communications module 58. Additional modules that may be added or interchanged in the stack include a telescope module 60, a weapons module 62, a tilting module 64, a spring module (for a bobblehead) 66, a bellows module 68, and a quick response (QR) code scanner module 69. It is further appreciated that modules with functions not depicted herein may also be included in the multi-function modular robot apparatus 10. Representative module functions not depicted herein include, but are not limited to, robot arms, probes, sensors, a fog machine module, a universal serial bus (USB) port module, an infrared detector module, a laser range detector module, a sonic range detector module, a motion detector module, a multi laser light show module, a battery module, an auxiliary jack input module, a speaker module, a video projector module, a microphone module, a smoke detector module and a carbon monoxide detector module. In certain inventive embodiments, the display module 48 contains a clear dome 49 positioned at the top of the stack of the first plurality of modules 11 and has one or a combination of: video screen displays, avatars, heads, toys-to-life figurines, bobble-heads, arms, hands, sculptures, models, mini robots, animatronics and art. In other embodiments the communications module 58 enables one or a combination of: radio frequency (RF), Bluetooth, Wi-Fi, and cellular communication. Multiple communication modules may be included in the stack. In still other embodiments, the weapons module 62 has one or a combination of: a laser beam, infra red (IR) beam, spit-ball launcher, projectile launcher, flame thrower, flash bomb, poison dart gun, poker, kicker, hammer, robot arm, and water gun. In some inventive embodiments, the lights module 50 has upward, downward, inward and outward facing lights. In other embodiments the tilting module 64 has a hexapod. The robotic platform 32 has a motor 70, a plurality of wheels 72, a bumper 74, a battery pack housing 76, and a rechargeable and removable battery back 78. It is appreciated that the bumper 74 may be freely rotating or driven by a motor to rotate. It is also appreciated that the bumper 74 may have different shapes to enable interaction with different targets that may be part of a game played with the multi-function modular robot apparatus 10.

It is noted that while modules (11, 84) are shown to have equivalent dimensions, the modules may have any size or shape, but would need to have the top and bottom complementary interfaces as described herein. It is also noted that a top module does not have to have a top interface, and may only have a bottom interface in order to engage the module bellow the top module in the stack of user configurable modules.

Figure 4:
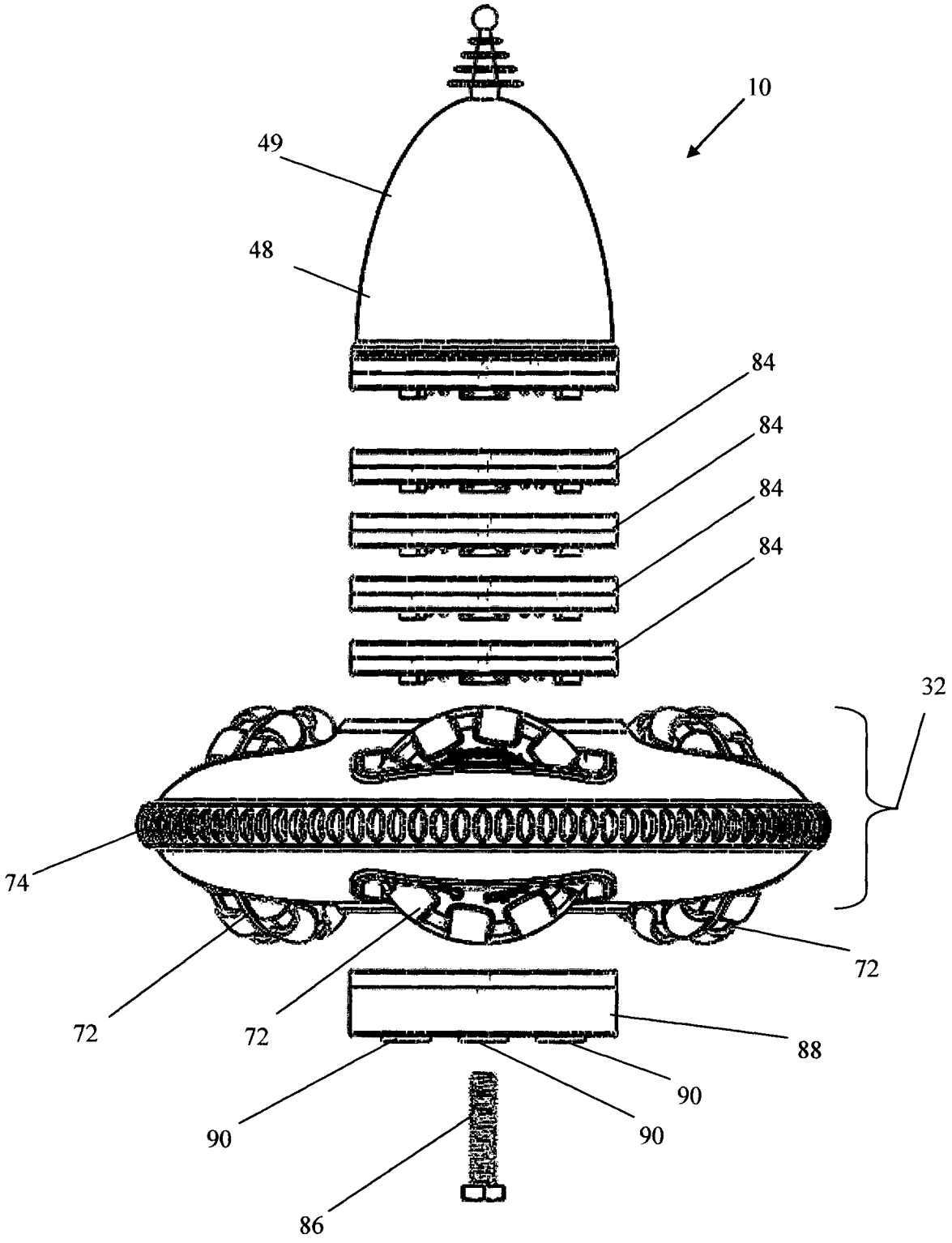
FIG. 4 is a perspective view of the second plurality of stackable modules of the multi-function modular robot apparatus shown in FIG. 1 secured with a bolt according to one embodiment of the invention.
Figure 5A:
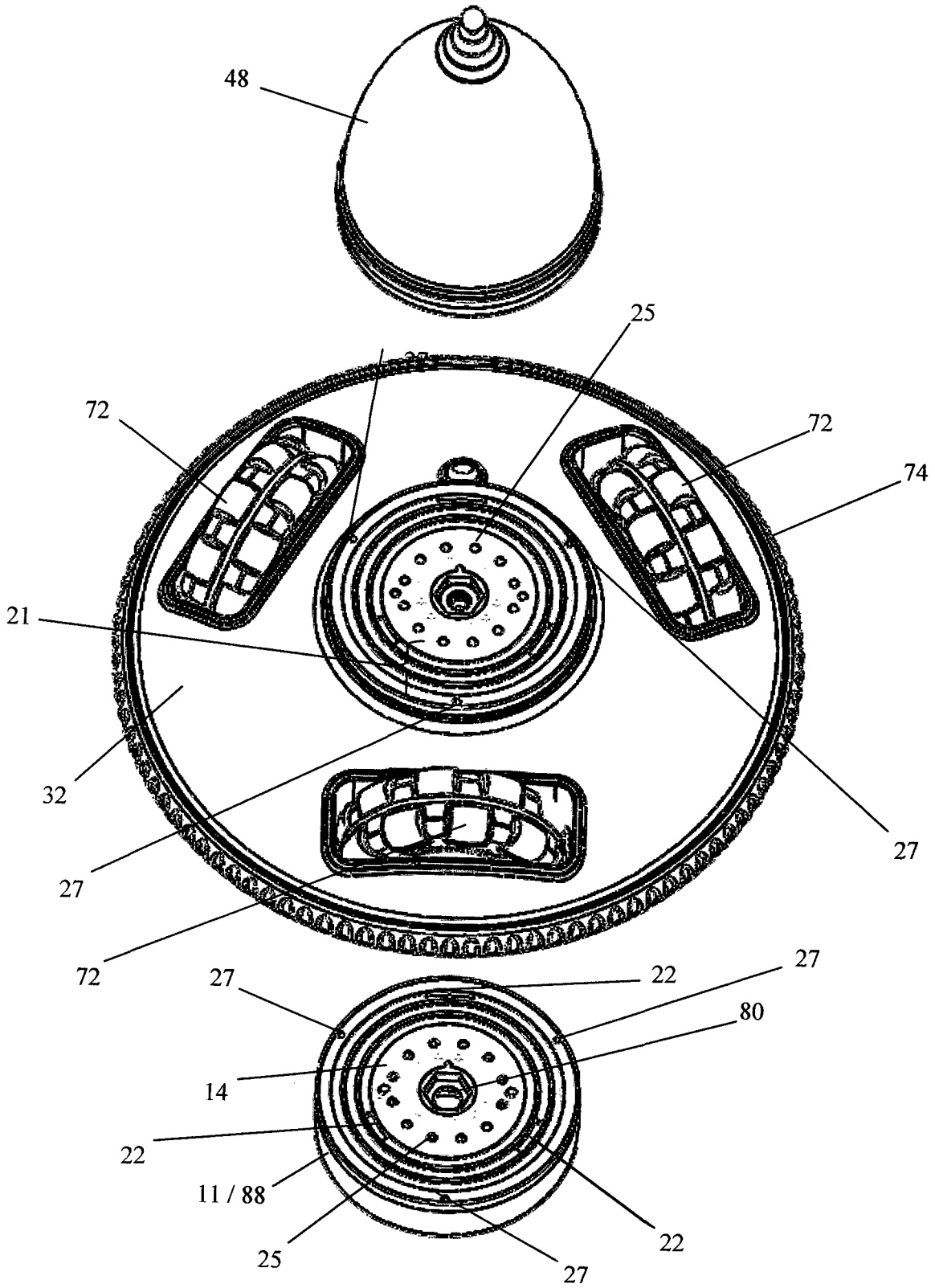
FIGS. 5A and 5B are exploded perspective top and bottom views, respectively of the multi-function modular robot apparatus according to one embodiment of the invention.
Figure 5B:
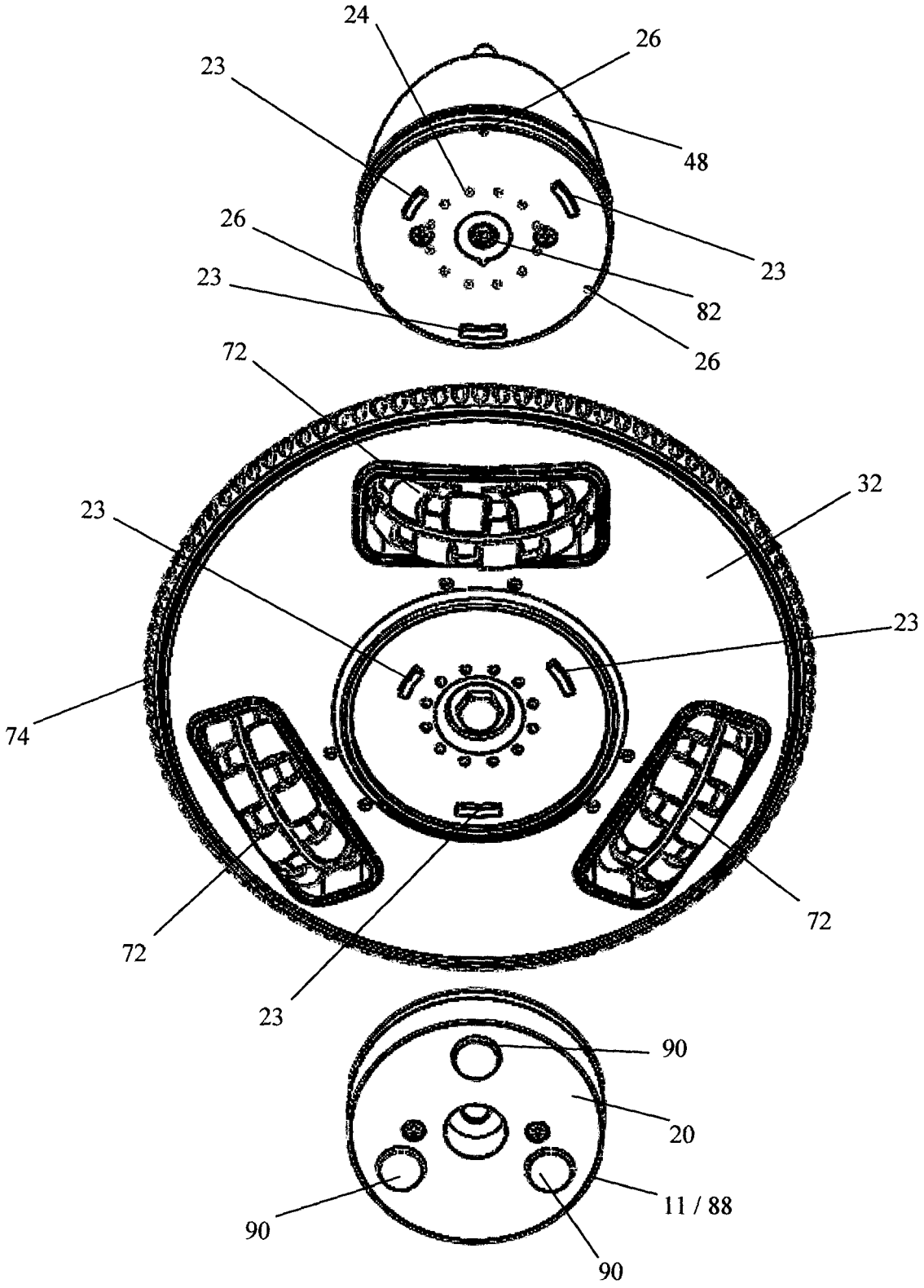

As shown in FIGS. 3A-3E in conjunction with FIG. 4, in specific inventive embodiments, each of the first plurality of modules 11 has a hole 80 through the middle of the top face 14 and the bottom face 16. It is appreciated that the hole is of sufficient size to allow for the pass through of one of a plurality of bolt components 86 operable to securely mount heavier modules of the first plurality of modules 11. A nut 82, as best shown in FIG. 5B, is secured in the bottom display module 48 and is operable to secure one of the plurality of bolt components 86. In some inventive embodiments, a second plurality of stackable modules 84 is provided, each module of the second plurality of stackable modules 84 has a hole 80 through the middle of the top face 14 and the bottom face 16 and the hole 80 is adapted to allow the pass through of one of the plurality of bolt components 86 operable to securely mount heavier modules of the first plurality of stackable modules 11. It is appreciated that the nut 82 may be removed or installed in each module 84, so in conjunction with different length bolts, various module stacks may be achieved—with the top module having the nut.

It is appreciated that each module of the second plurality of modules 84 is adapted to enable power and electronic pass through only. The plurality of interchangeable bolt components 86 each have a length corresponding to the height of between two and thirty stacked modules from the first plurality of modules 11, the second plurality of modules 84, or a combination thereof are operable to accommodate a variety of module configurations. In specific inventive embodiments, a separate power stand component 88 has an interface identical to the interface 22 on top of the modules and is operable to charge the battery pack 78 while still in the robot via USB port or wall outlet connection. The use of a battery pack 78 enables configurations of the functional stacks of modules to function independently of a plug-in power source thereby allowing the mounting of the multi function device on vehicles, bicycles, and wearable attire.

It is appreciated that in some inventive embodiments, the battery pack 78 may be charged while still in the robot—an identical interface to module bottom interface 24 on the bottom of the robot (not shown) engages the power stand 88. A mobile robot docking and charging station is detailed in U.S. patent application Ser. No. 6,764,373. This also enables the modules to be stacked on the power stand 88 and function on a desk or display case as though they were on the robot. The power stand 88 has a bottom face 20 that may be configured with rubber pads/feet 90. In some embodiments, a separate user operable master remote control 100 is provided that is adapted to enable control of the functions of the various modules of the first plurality of modules 11 and to enable control of the movement of the multi-function modular robot apparatus 10. While the separate user operable master remote control 100 is depicted herein as a handset with buttons, switches, and a joystick, it is appreciated that the separate user operable master remote control 100 may also be a Smartphone, tablet, laptop or computer running an application (app) connected to the communications module 58 of the multi-function modular robot apparatus 10.

An embodiment of the second plurality of stackable modules 84 of the multi-function modular robot apparatus 10 shown in FIG. 4 according to one embodiment of the invention. It is appreciated that each module of the second plurality of stackable modules 84 is adapted to enable power and electronic pass through only. It is further appreciated that the second plurality of stackable modules 84 are provided to serve as "dummy" modules to accommodate one of the bolts from the plurality of interchangeable bolt components 86.

Figure 6:
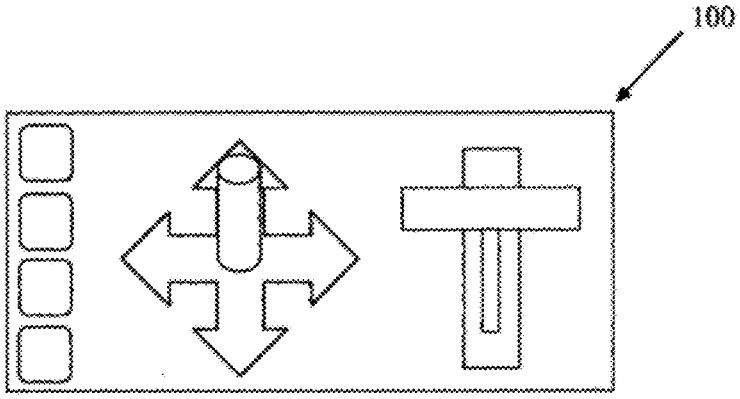
FIG. 6 is a perspective view of the master remote control component of the multi-function modular robot apparatus shown in FIG. 1 according to one embodiment of the invention

An embodiment of the master remote control component 100 of the multi-function modular robot apparatus 10 is shown in FIG. 6 according to one embodiment of the invention. While the separate user operable master remote control 100 is depicted herein as a handset with buttons, switches, and a joystick, it is appreciated that the separate user operable master remote control 100 can also be a Smartphone, tablet, laptop or computer running an app connected to the communications module 58 of the multi-function modular robot apparatus 10.

Figure 7:
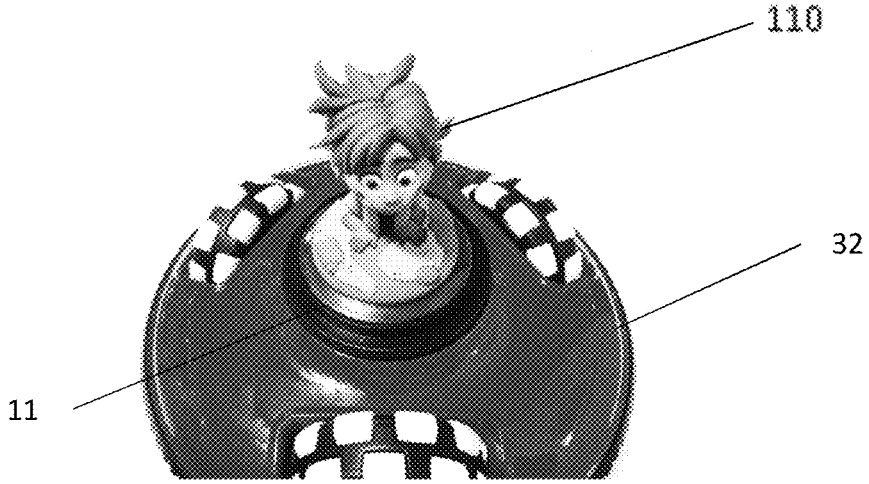
FIG. 7 is a photograph of a toys-to-life figurine positioned on a robotic platform in accordance with embodiments of the invention.
Figure 8:
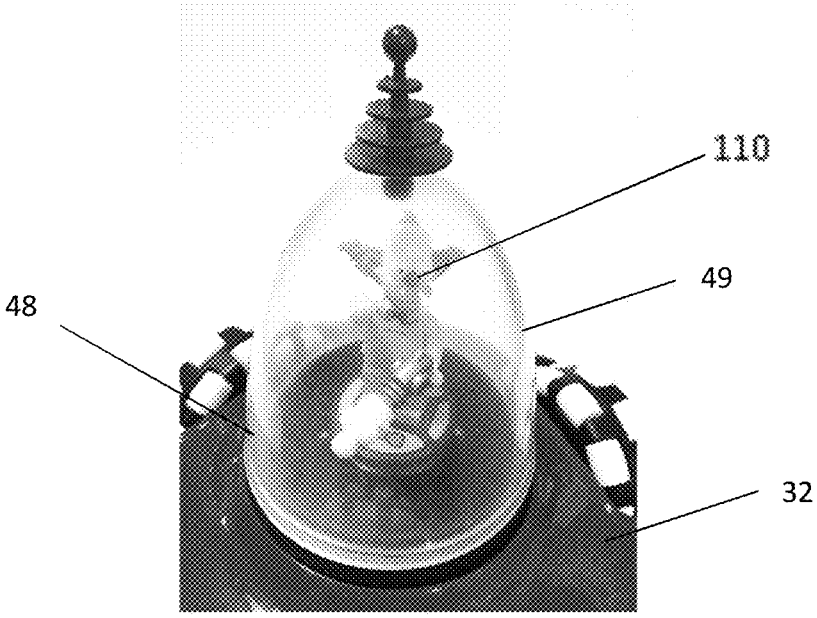
FIG. 8 is a photograph of a toys-to-life figurine positioned in a display module with a clear dome atop a robotic platform in accordance with embodiments of the invention

FIG. 7 is a photograph of a toys-to-life figurine 110 positioned on a robotic platform 32, and FIG. 8 is a photograph of a toys-to-life figurine positioned in a display module with a clear dome 49 atop a robotic platform 32. In specific embodiments the sensors (RFID, NFC, 2D barcode, QR code, etc.) of the a toys-to-life figurine 110 may be incorporated into one of the stackable modules 11. The use of toys-to-life figurines 110 in conjunction with the robotic platform 32 allows characters to not only function with their games, but also be able to move around, have additional functionality and participate in real-world robot games. Embodiments of the inventive robots 32 may play physical games that may be simulated in a virtual world (with a simulator/video game) so that users can practice the physical game from anywhere on their various computers, portable devices, and Smartphone devices.

In a specific embodiment, a method of playing a target-and-shoot game is provided that includes the securing of an inventive multi-function robot apparatus to a vehicle such as an automobile, or a bicycle. The vehicle then travels along a route while a user finds "targets" by imaging QR code targets or laser tag targets posted along the route using a separate user operable remote control component. Embodiments of the multi-function robot apparatus may be attached to an automobile, motorcycles, or other motorized vehicle with a magnetic base. Embodiments of the multifunction apparatus may also be affixed to remote controlled vehicles illustratively including drones. Embodiments of the multi-function robot apparatus may be attached to a bicycle with a handlebar attachment via the plurality of interchangeable bolt components 86 described above. In a specific inventive embodiment, the multi-function robot apparatus may be used as a wearable device with for example attachment to a helmet or shoulder pads with a bolt from inside thru a hole in the top of the helmet.

It is appreciated with the ability to mount to just about anything, use of embodiments of the inventive multi-function robot apparatus are not restricted to playing the game(s) in a confined space such as a stadium. Some games (laser tag, projectile shooting, light cannon, etc.) may then be played in any space by having targets that can be mounted on walls, in windows, free-standing, where the targets are all enabled by the Internet of things in which everything can be connected.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

Although the present invention has been described with reference to preferred embodiments, numerous modifications and variations can be made and still the result will come within the scope of the invention. No limitation with respect to the specific embodiments disclosed herein is intended or should be inferred.

The invention claimed is:

1. A multi-function modular robot apparatus comprising:

a first plurality of stackable interlocking and interchangeable modules, each of said first plurality of stackable interlocking and interchangeable modules comprising: a module housing having a top face and a bottom face, said top face adapted to receive an interlocking mechanical and electrical communications component integral with said bottom face of another of said first plurality of stackable interlocking and interchangeable modules, each of said first plurality of stackable interlocking and interchangeable modules providing an entertainment or operational function of said modular robot apparatus; and a robotic platform comprising: a housing and a plurality of wheels, said housing having a module interface cutout adapted to receive said bottom face of one of said first plurality of stackable interlocking and interchangeable modules;

wherein one of said first plurality of stackable interlocking and interchangeable modules is:

a display module containing a clear, domed display positioned at the top of the stack of said first plurality of stackable interlocking and interchangeable modules and further comprises one or a combination of: video screen displays, avatars, heads, bobble-heads, toys-to-life figurines, arms, hands, sculptures, models, mini robots, animatronics or art;

a weapons module comprising one or a combination of: a laser beam, infra red (IR) beam, spit-ball launcher, projectile launcher, flame thrower, flash bomb, poison dart gun, poker, kicker, hammer, robot arm, or water gun; or a tilting module comprising a hexapod; and wherein each of said first plurality of stackable interlocking and interchangeable modules has a hole through the middle of said top face and said bottom face, said hole adapted to allow the pass-through of a bolt operable to securely mount heavier modules of said first plurality of stackable modules.

2. The multi-function robot apparatus of claim 1 wherein another of said first plurality of stackable interlocking and interchangeable modules has at least one of the following functions: computer driver, motor driver, one or more cameras, sound, turret, telescope, springing, bellows, fog machine, quick response (QR) code scanner, universal serial bus (USB) ports, port module, an infrared detector module, a laser range detector module, a sonic range detector module, a motion detector module, a multi laser light show module, a battery module, auxiliary jack inputs, speakers, video projector, microphone, smoke detector or carbon monoxide detector.

3. The multi-function robot apparatus of claim 1 wherein another of said first plurality of stackable interlocking and interchangeable modules is a communications module that enables one or a combination of: radio frequency communication, Bluetooth communication, Wi-Fi communication or cellular communication.

4. The multi-function robot apparatus of claim 1 wherein another of said first plurality of stackable interlocking and interchangeable modules is a lights module comprising upward, downward, inward and outward facing lights, lasers or light emitting diodes (LEDs).

5. The multi-function robot apparatus of claim 1 wherein said robotic platform further comprises a motor, a bumper, a battery pack housing and a rechargeable battery pack.

6. The multi-function robot apparatus of claim 5 wherein said bumper rotatably connected to said robotic platform; and wherein said bumper has one or more different shapes that correspond to a set of targets.

7. The multi-function robot apparatus of claim 1 further comprising a nut in the bottom of the clear, domed display module positioned at the top of the stack of said first plurality of stackable interlocking and interchangeable modules operable to secure said bolt in place.

8. The multi-function robot apparatus of claim 1 further comprising a second plurality of stackable interlocking and interchangeable modules with a hole through the middle of said top face and said bottom face, said hole adapted to allow the pass through of said bolt operable to securely mount heavier modules of said first plurality of stackable interlocking and interchangeable modules, said second plurality of stackable interlocking and interchangeable modules adapted to enable power and electronic pass through only.

9. The multi-function robot apparatus of claim 8 further comprising a plurality of interchangeable bolt components each having a length corresponding to the height of between two and thirty stacked modules of said first plurality of stackable interlocking and interchangeable modules, said second plurality of stackable interlocking and interchangeable modules, or a combination thereof.

10. The multi-function robot apparatus of claim 1 further comprising a separate power stand component, operable to charge a battery pack while still in the robot via USB port or wall outlet connection.

11. The multi-function robot apparatus of claim 1 further comprising a separate user operable master remote control component adapted to enable control and programming of said functions of each of said first plurality of stackable interlocking and interchangeable modules and to enable control of the movement of said multi-function robot apparatus.

12. The multi-function robot apparatus of claim 11 wherein said separate user operable master remote control component is a joystick, Smartphone, tablet, laptop, or computer.

13. The multi-function robot apparatus of claim 1 wherein any one of said first plurality of stackable interlocking and interchangeable modules has the top face oriented parallel to the bottom face.

14. The multi-function robot apparatus of claim 1 further comprising a first magnet disposed within any one of said first plurality of stackable interlocking and interchangeable modules, a second magnet disposed within another of said first plurality of stackable interlocking and interchangeable modules and adapted to actively engage the any one of said first plurality of stackable interlocking and interchangeable modules having the first magnet disposed therein.

15. The multi-function robot apparatus of claim 1 further comprising a power stand adapted to charge at least one of: said robotic platform or at least one of said first plurality of stackable interlocking and interchangeable modules.

16. A method of playing a target-and-shoot game comprising:

securing said multi-function robot apparatus of claim 1 on the roof of an automobile;

driving said automobile along a route;

finding and imaging a set of QR code targets or finding a set of laser tag targets posted along said route using a separate user operable remote control component, where a user shoots at the set of laser tag targets with a laser weapon, and the set of laser tag targets are linked to the Internet.

17. The method of claim 16 wherein said separate user operable remote control component is a Smartphone, tablet, laptop or computer.

* * * * *